US009733593B2

(12) United States Patent
Hasegawa et al.

(10) Patent No.: US 9,733,593 B2
(45) Date of Patent: Aug. 15, 2017

(54) ELECTROSTATIC CHARGE IMAGE DEVELOPING CARRIER, ELECTROSTATIC CHARGE IMAGE DEVELOPER, DEVELOPER CARTRIDGE, PROCESS CARTRIDGE, AND IMAGE FORMING APPARATUS

(71) Applicant: FUJI XEROX CO., LTD., Tokyo (JP)

(72) Inventors: Toshiaki Hasegawa, Kanagawa (JP); Norihito Fukushima, Kanagawa (JP); Shintaro Anno, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 14/608,409

(22) Filed: Jan. 29, 2015

(65) Prior Publication Data

US 2016/0026120 A1 Jan. 28, 2016

(30) Foreign Application Priority Data

Jul. 25, 2014 (JP) ..... 2014-152312

(51) Int. Cl.

| | |
|---|---|
| ***G03G 9/10*** | (2006.01) |
| ***G03G 15/09*** | (2006.01) |
| ***G03G 9/113*** | (2006.01) |
| ***G03G 9/107*** | (2006.01) |
| ***G03G 15/02*** | (2006.01) |
| ***G03G 15/08*** | (2006.01) |

(52) U.S. Cl.

CPC ..... *G03G 15/0907* (2013.01); *G03G 9/1075* (2013.01); *G03G 9/113* (2013.01); *G03G 9/1137* (2013.01); *G03G 15/0233* (2013.01); *G03G 15/0818* (2013.01)

(58) Field of Classification Search

CPC .... G03G 15/0907; G03G 9/00; G03G 9/1075; G03G 9/1137

USPC ..... 430/113.32, 113.35

See application file for complete search history.

(56) References Cited

U.S. PATENT DOCUMENTS

| | | | | |
|---|---|---|---|---|
| 5,631,116 A * | 5/1997 | Uchida | ..... | G03G 9/1133 428/407 |
| 5,821,023 A * | 10/1998 | Shibuya | ..... | G03G 9/1131 399/225 |
| 2009/0061333 A1* | 3/2009 | Matsumoto | ..... | G03G 9/0819 430/48 |

FOREIGN PATENT DOCUMENTS

| | | | |
|---|---|---|---|
| JP | 10-161354 A | | 6/1998 |
| JP | 3691085 B2 | | 8/2005 |
| JP | 2007-086721 A | | 4/2007 |
| JP | 2009-192959 | * | 8/2009 |

OTHER PUBLICATIONS

Machine Translation of JP2009-192959.*

* cited by examiner

*Primary Examiner* — Thorl Chea
(74) *Attorney, Agent, or Firm* — Sughrue Mion, PLLC

(57) ABSTRACT

An electrostatic charge image developing carrier includes a magnetic core particle, and a coating layer that coats surfaces of the magnetic core particle, wherein the coating layer includes a binder resin, thermosetting resin particles, and crosslinked resin particles, and the crosslinked resin particle contains a polymer formed by polymerizing a monomer component including the same monomer as a monomer used in the polymerization of the binder resin.

8 Claims, 2 Drawing Sheets

ELECTROSTATIC CHARGE IMAGE DEVELOPING CARRIER, ELECTROSTATIC CHARGE IMAGE DEVELOPER, DEVELOPER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-152312 filed Jul. 25, 2014.

BACKGROUND

1. Technical Field

The present invention relates to an electrostatic charge image developing carrier, an electrostatic charge image developer, a developer cartridge, a process cartridge, and an image forming apparatus.

2. Related Art

Generally, electrostatic charge image developing carriers used in an electrostatic charge image developer are roughly divided into resin coated carriers in which a coating layer of a binder resin is formed on the surface of a magnetic core particle, and non-coated carriers in which a coating layer is not formed on the surface of a magnetic core particle, and in recent years, resin coated carriers have been used in many cases.

SUMMARY

According to an aspect of the invention, there is provided an electrostatic charge image developing carrier including:

a magnetic core particle; and a coating layer that coats surfaces of the magnetic core particle, wherein the coating layer includes a binder resin, thermosetting resin particles, and crosslinked resin particles, and the crosslinked resin particle contains a polymer formed by polymerizing a monomer component including the same monomer as a monomer used in the polymerization of the binder resin.

BRIEF DESCRIPTION OF THE DRAWINGS

Exemplary embodiments of the present invention will be described in detail based on the following figures, wherein.

DETAILED DESCRIPTION

Figure 1:
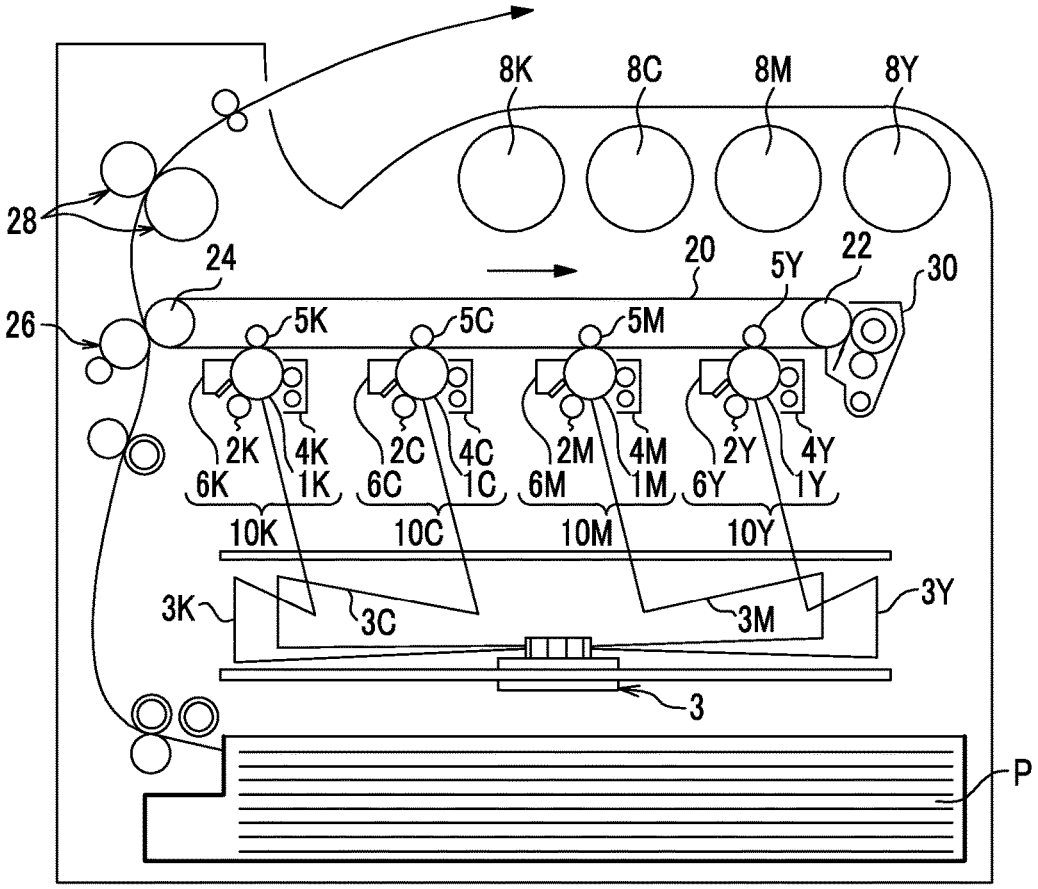
FIG. 1 is a configuration diagram schematically showing an example of an image forming apparatus according to an exemplary embodiment.

Hereinafter, exemplary embodiments of the invention will be described in detail.

Electrostatic Charge Image Developing Carrier

An electrostatic charge image developing carrier according to an exemplary embodiment (hereinafter, also simply referred to as a "carrier") includes magnetic core particle (hereinafter, also simply referred to as "core") and a coating layer that coats surfaces of the magnetic core particle. The coating layer includes a binder resin, thermosetting resin particles, and crosslinked resin particles, and a polymer obtained by polymerizing at least the same monomer as a monomer used in the polymerization of the binder resin is used as the crosslinked resin particles.

In addition, the "same monomer" refers to a monomer having the same structure remaining in the resin after polymerization, that is, when the molecular structure of the binder resin and the crosslinked resin particles constituting the coating layer is observed, the monomer is determined based on whether or not the same structure is present between groups which are considered to be formed by a polymerization reaction.

In addition, the thermosetting resin particles refer to resin particles having a three-dimensional structure which is not softened by heating in a resin in which a network structure is formed in the molecular structure and cured by heating. On the other hand, the crosslinked resin particles refer to resin particles having a crosslinked structure in which a chemical bond is formed between specific atoms among plural linear polymer structures.

As for a carrier used in a developer for forming an image by electrophotography, from the viewpoint of maintaining stable charging performance, it is preferable to prevent a change in the surface composition and the structure for a long period of time. In addition, when a toner additive such as an external additive separated from the toner in the developer is attached to the carrier, the composition of the carrier surface is changed in some cases.

Here, a method of preventing a change in the surface composition and the structure by making the coating layer of the carrier soft enough to cause wear due to friction with the toner additive and friction between the carriers, and promoting the removal of the toner additive attached to the surface with a part of the coating layer to be scraped by the wear may be considered.

However, when the coating layer is excessively soft, the coating layer is peeled off or scraped due to the friction with the toner additive and the friction between the carriers and the surface composition is rather changed. Thus, the carrier with lowered electric resistance is developed and an image holding member (photoreceptor), an image holding member cleaning member, or the like is contaminated or damaged. As a result, image defects such as white spots occur in some cases. In addition, this phenomenon becomes more significant as the temperature and the humidity becomes higher.

Accordingly, a method of controlling the degree of wear to an appropriate amount such that excessive peeling-off or scraping does not occur while controlling the coating layer of the carrier to cause wear as described above may be considered.

Here, the carrier according to the exemplary embodiment contains a binder resin, thermosetting resin particles, and crosslinked resin particles in the coating layer.

Further, typically, as the binder resin in the coating layer, a resin which is soft enough to cause wear due to friction with a toner additive and friction between the carriers is used. In addition, as the crosslinked resin particles and the thermosetting resin particles, particles having higher hardness than that of the binder resin, that is, imparting the performance capable of preventing the wear of the coating layer, are used. Further, since the crosslinked resin particles are generally softer than the thermosetting resin particles, as compared to the thermosetting resin particles, wear easily occurs due to friction with a toner additive and friction between carriers.

That is, in the coating layer of the exemplary embodiment containing both thermosetting resin particles and the crosslinked resin particles having different hardness, while the wear is prevented, the degree of wear may be controlled to cause an appropriate degree of wear to remove the toner additive attached to the surface of the carrier.

However, the particles to be contained in the coating layer are sometimes separated from the coating layer as the coating layer becomes worn, and the crosslinked resin particles which are softer than the thermosetting resin particles are more quickly worn than the thermosetting resin particles. Thus, the separation occurs more easily. At a site from which the crosslinked resin particles are removed in the coating layer, the particles are separated and thus the binder resin is exposed. Therefore, the site is more easily worn and as a result, the coating layer is peeled off or scraped to cause a change in the surface composition.

Contrarily, in the carrier according to the exemplary embodiment, a polymer obtained by polymerizing at least the same monomer as a monomer used in the polymerization of the binder resin is further used as the crosslinked resin particles.

Accordingly, the adhesion between the crosslinked resin particles and the binder resin is increased, the separation of the crosslinked resin particles from the coating layer is prevented, and a change in the surface composition is prevented. As a result, a toner charge amount stable for a long period of time may be obtained. Then, image defects such as white spots are prevented from occurring.

Hereinafter, the configuration of the carrier according to the exemplary embodiment will be described.

Magnetic Core Particle

The magnetic core particle is not particularly limited, and examples thereof include a magnetic metal such as iron, steel, nickel, or cobalt, a magnetic oxide such as ferrite or magnetite, and a resin particle having magnetic particles dispersed therein. Specifically, a magnetic material may be used, and the magnetic material is obtained by using magnetic particle itself as a core particle or by pulverizing magnetic particle and dispersing the pulverized powder in a resin.

Examples of the resin used in the magnetic core particle include a styrene resin, an acrylic resin, a styrene-acrylic copolymer resin, a polyolefin resin, and a phenol resin.

The volume average particle size of the magnetic core particles is preferably from 20 μm to 100 μm. When the volume average particle size of the magnetic core particles is 20 μm or more, the particles are prevented from being developed with toner when a carrier is formed using the particles. When the volume average particle size is 100 μm or less, toner may be evenly charged when a carrier is formed using the particles.

Coating Layer

Examples of a resin coating method of coating the surfaces of the magnetic core particles with a coating layer include a wet method using a solvent and a dry method not using a solvent.

Examples of the wet method include a dipping method in which a binder resin, thermosetting resin particles, crosslinked resin particles, additives such as other conductive materials, and the like are added to a solvent capable of dissolving a binder resin to obtain a coating layer forming solution, and magnetic core particles are dipped in the coating layer forming solution, a spraying method in which a coating layer forming solution is sprayed on the surfaces of the magnetic core particles, a fluidized-bed method in which a coating layer forming solution is sprayed while the magnetic core particles are made to float by flowing air, and a kneader coater method in which the magnetic core particles are mixed with a coating layer forming solution in a kneader coater and then a solvent is removed.

Examples of the dry method include a method in which resin particles obtained by synthesizing resin particles by an emulsion polymerization method, a suspension polymerization method, or the like, or by pulverizing and classifying the synthesized resin or emulsifying and dispersing the synthesized resin in water, and magnetic core particles are mixed, and the mixture is fixed to the surfaces of the magnetic core particles by applying a mechanical impact force, as necessary, heated to the glass transition temperature of the resin or higher, and melted to form a coating layer. A method of adding the thermosetting resin particles, the crosslinked resin particles, and the additives such as other conductive materials, or the like in the coating layer in the dry method is not particularly limited and the components may be added after resin particles for coating (binder resin) are mixed in advance or may be individually added. However, since it is preferable to obtain an even structure, mixing of the components in advance is preferable. In addition, as the adding method, the composition ratio may be changed and the components may be added plural times in a divided manner to control the structure of the coating layer.

In the exemplary embodiment, although not particularly limited, the carrier is preferably formed by the dry method in which resin particles prepared by polymerization and drying using the emulsion polymerization method are fixed to the surfaces of the magnetic core particles.

Binder Resin

When the carrier is produced by the dry method in the exemplary embodiment, the binder resin is preferably used as resin particles and the resin particles may be prepared by using a method in which resin particles are synthesized by an emulsion polymerization method, a suspension polymerization method, or the like, or the synthesized resin is pulverized and classified or the synthesized resin is emulsified and dispersed in water. In the exemplary embodiment, the resin particles prepared by polymerization and drying using the emulsion polymerization method are preferably used.

In addition, the volume average particle size of the resin particles is typically 3 μm or less, and preferably in a range of 10 nm to 1,000 nm.

When the volume average particle size of the resin particles is 3 μm or less, the finally obtained thickness of the coating layer of the carrier is accurately controlled and various kinds of additives is evenly dispersed. In addition, the compositional segregation in the coating layer of the carrier is reduced and thus it is preferable in that fluctuation in performance and reliability is reduced. Further, the volume average particle size of the resin particles may be measured using, for example, a micro track.

As a monomer to be used as the binder resin in the coating layer, as long as the monomer is obtained by polymerization, the monomer may be used singly or a copolymer obtained by polymerization of two or more kinds of monomers may be used. Although not particularly limited, examples thereof include a styrene monomer, a (meth)acrylic monomer, a polyvinyl monomer.

Examples of the styrene monomer include a styrene monomer.

Examples of the (meth)acrylic monomer include a (meth) acrylic monomer, and an alkyl (meth)acrylate monomer. Examples of the alkyl (meth)acrylate monomer include a methyl (meth)acrylate monomer, an ethyl (meth)acrylate monomer, and an alicyclic alkyl (meth)acrylate monomer such as a cyclohexyl (meth)acrylate monomer.

Among these, a copolymer of a styrene monomer and a (meth)acrylic monomer having particularly satisfactory charge controllability is preferable and particularly from the viewpoint of low hygroscopicity, an alicyclic alkyl (meth) acrylate monomer such as a cyclohexyl (meth)acrylate monomer is more preferable. Examples of an alicyclic (meth)acrylate ester resin include a cyclohexyl methacrylate resin.

In addition, as the binder resin, resins other than the above-described resins may be used in a mixed manner. Examples thereof include polyethylene, polypropylene, polystyrene, polyacrylonitrile, polyvinyl acetate, polyvinyl alcohol, polyvinyl butyral, polyvinyl chloride, polyvinylcarbazole, polyvinyl ether, polyvinyl ketone, polyacrylate, a vinyl chloride-vinyl acetate copolymer, a styrene-acrylic acid copolymer, fluororesins, polyester, and polycarbonate, but are not limited thereto.

Further, in the exemplary embodiment, a binder resin obtained by polymerizing at least the same monomer as a monomer used in the polymerization of the crosslinked resin particles is used as the binder resin.

The ratio of the same monomer as the monomer used in the polymerization of the crosslinked resin particles in the total monomer is preferably 50 mol % or more, more preferably 80 mol % or more, and still more preferably 90 mol % or more. When the ratio is equal to the lower limit or more, the adhesion between the binder resin for forming the coating layer and the crosslinked resin particles becomes satisfactory and thus the separation of the crosslinked resin particles from the coating layer is prevented.

Thermosetting Resin Particles

In the exemplary embodiment, thermosetting resin particles are added to the coating layer. The thermosetting resin particles refer to resin particles having a three-dimensional structure which is not softened by heating in a resin has a network structure formed in the molecular structure and cured by heating.

The thermosetting resin particles to be used are not particularly limited as long as the resin is a resin with a thermosetting property, but particles containing a nitrogen element are preferable. Among them, a melamine resin (for example, melamine-formaldehyde condensed resin), urea resin, a urethane resin, a guanamine resin (for example, benzoguanamine-formaldehyde condensed resin), and an amine resin have high positive charging properties and the hardness of the resin is high. Thus, a decrease in the charge amount due to the peeling-off or the like of the coating layer is prevented and the resins are preferable.

Examples of commercially available products include EPOSTAR S (manufactured by Nippon Shokubai Co., Ltd., melamine-formaldehyde condensed resin), and EPOSTAR MS (manufactured by Nippon Shokubai Co., Ltd., benzoguanamine-formaldehyde condensed resin).

Crosslinked Resin Particles

Further, in the exemplary embodiment, crosslinked resin particles (resin particles having a crosslinked structure) are contained in addition to the thermosetting resin particles. The crosslinked resin particles refer to resin particles having a crosslinked structure in which a chemical bond is formed between specific atoms among plural linear polymer structures.

As the crosslinked resin particle, a copolymer obtained by polymerizing at least the same monomer as the monomer used in the polymerization of the binder resin is used and as long as the monomer is used in the polymerization of the binder resin, the monomer is not particularly limited. For example, a resin using at least one selected from a styrene monomer, a (meth)acrylic monomer, and a polyvinyl monomer having satisfactory charge controllability is preferable.

Examples of the styrene monomer include a styrene monomer.

Examples of the (meth)acrylic monomer include a (meth) acrylic monomer, and an alkyl (meth)acrylate monomer. Examples of the alkyl (meth)acrylate monomer include a methyl (meth)acrylate monomer, an ethyl (meth)acrylate monomer, and an alicyclic alkyl (meth)acrylate monomer such as a cyclohexyl (meth)acrylate monomer.

Among resins obtained from these monomers, an alicyclic (meth)acrylic acid ester resin having low hygroscopicity is more preferable. Examples of the alicyclic (meth)acrylic acid ester resin include a cyclohexyl methacrylate resin.

As the crosslinked resin particles, a monomer containing nitrogen may be used to obtain a charge imparting effect. Examples thereof include dialkylaminoalkyl (meta)acrylate such as diethylaminoethyl (meta)acrylate, and dimethylamino ethyl(meta)acrylate, alkylamino alkyl(meta)acrylate such as ethylamino ethyl(meta)acrylate, and methylamino ethyl(meta)acrylate, aminoalkyl (meta)acrylate such as aminoethyl (meta) acrylate, 1,2,2,6,6-pentamethyl-4-piperidyl-methacrylate, and 2,2,6,6-tetramethyl-4-piperidyl-methacrylate.

The ratio of the same monomer as the monomer used in the polymerization of the binder resin in the total monomer is preferably 50 mol % or more, more preferably 80 mol % or more, and still more preferably 90 mol % or more. When the ratio is equal to the lower limit or more, the adhesion between the binder resin for forming the coating layer and the crosslinked resin particles becomes satisfactory and thus the separation of the crosslinked resin particles from the coating layer is prevented.

When the crosslinked resin particles are produced, a method of forming the crosslinked structure is not particularly limited but a crosslinking agent such as a crosslinkable monomer may be used.

Specific examples of the crosslinking agent include aromatic polyvinyl compounds, such as divinyl benzene and divinyl naphthalene; polyvinyl esters of aromatic polyvalent carboxylic acid, such as divinyl phthalate, divinyl isophthalate, divinyl terephthalate, divinyl homophthalate, divinyl/trivinyl trimesates, divinyl naphthalene dicarboxylate, and divinyl biphenyl carboxylate; divinyl esters of nitrogen-containing aromatic compounds, such as divinyl pyridine dicarboxylate; vinyl esters of unsaturated heterocyclic compound carboxylic acids, such as vinyl pyromucate, vinyl furan carboxylate, vinyl pyrrole-2-carboxylate, and vinyl thiophene carboxylate; (meth)acrylic acid esters of linear polyols, such as butanediol methacrylate, hexanediol acrylate, octanediol methacrylate, decanediol acrylate, and dodecanediol methacrylate; branched and substituted polyol (meth)acrylic acid esters, such as neopentyl glycol dimethacrylate and 2-hydroxy-1,3-diacryloxy propane; polyethylene glycol di(meth)acrylates and polypropylene polyethylene glycol di(meth)acrylates; and polyvinyl esters of polyvalent carboxylic acid, such as divinyl succinate, divinyl fumarate, vinyl/divinyl maleates, divinyl diglycolate, vinyl/divinyl itaconates, divinyl acetone dicarboxylate, divinyl glutarate, divinyl 3,3'-thiodipropionate, divinyl/trivinyl trans-aconates, divinyl adipate, divinyl pimelate, divinyl suberate, divinyl azelate, divinyl sebacate, dodecanedioic acid divinyl, divinyl brassylate.

In the exemplary embodiment, these crosslinking agents may be used singly or in combination of two or more kinds. In addition, among these crosslinking agents, not to deteriorate the charging properties of the binder resin, acrylic crosslinking agents are preferable and (meth)acrylic acid esters of linear polyols, such as butanediol methacrylate, hexanediol acrylate, octanediol methacrylate, decanediol acrylate, and dodecanediol methacrylate; branched and substituted polyol (meth)acrylic acid esters, such as neopentyl glycol dimethacrylate and 2-hydroxy-1,3-diacryloxy propane; and polyethylene glycol di(meth)acrylates and polypropylene polyethylene glycol di(meth)acrylates are preferably used.

The content of the crosslinking agent is preferably in a range of 0.05% by weight to 50% by weight, and more preferably in a range of 5% by weight to 20.0% by weight with respect to the total amount of the monomer used for forming the crosslinked resin particles.

In the exemplary embodiment, a chain transfer agent, a surfactant, and the like, which will be described later, may be contained in the crosslinked resin particles.

Particle Ratio

By adjusting the ratio between the thermosetting resin particles and the crosslinked resin particles in the coating layer, the degree of wear of the coating layer may be adjusted. The weight ratio changes depending on a desired degree of wear but the ratio between the thermosetting resin particles and the crosslinked resin particles (thermosetting resin particles:crosslinked resin particles) is preferably 1:9 to 9:1, more preferably 1:4 to 4:1, and still more preferably 2:3 to 3:2.

Particles Addition Amount

The amount of resin particles added including thermosetting resin particles and crosslinkable particles to be used is preferably 0.01 parts by weight to 5 parts by weight, and more preferably 0.1 parts by weight to 0.5 parts by weight with respect to 100 parts by weight of the magnetic core particles.

When the amount of the both particles added is 5 parts by weight or less, sufficient strength of the coating layer is achieved and easy deterioration by stress when the coating layer is used is prevented. When the amount of the resin particles added is 0.01 parts by weight or more, a function of preventing a decrease in charge amount is exhibited.

Other Physical Properties of Particles

In the exemplary embodiment, the volume average particle size of the thermosetting resin particles and the crosslinked resin particles is typically 3 μm or less, and preferably in a range of 10 nm to 1,000 nm. When the volume average particle size of each of the particles is 3 μm or less, the exposure of the resin from the coating layer is prevented and also other additives are evenly dispersed and thus, the performance and reliability are improved. In addition, the strength of the coating layer of the carrier is appropriately maintained and the degree of wear in long-term use is controlled.

The particle size of the thermosetting resin particle may be the same as the particle size of the crosslinked resin particle or may be adjusted in consideration of dispersibility and the strength of the binder resin. The volume average particle sizes of the both particles may be measured using, for example, a micro track.

The composition, content, and particle size measuring method of the particles in the binder resin of the carrier according to the exemplary embodiment will be described. As a method of analyzing the composition, 5 g of the carrier and 100 g of toluene are put into a beaker, the binder resin is sufficiently dissolved by an ultrasonic dispersing machine, and the magnetic core particles are removed by a magnet. Then, insoluble components are filtered, washed and separated, then, the resultant is diluted again and additives such as a conductive material are separated from the thermosetting resin particles and the crosslinked resin particles by a centrifugal separator. 20 mg of the binder resin is dissolved in 10 mL of chloroform and the solution is filtered to analyze the composition by an infrared absorption spectrum analysis method. The content and the particle size may be also measured by separating particles using the same method.

Other Additives

A radical polymerization initiator used when emulsion polymerization is performed in the exemplary embodiment is not particularly limited. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl triphenylperacetate hydroperoxide, tert-butyl performate, tert-butyl peracetate, tert-butyl perbenzoate, tert-butyl perphenylacetate, tert-butyl permethoxyacetate, and N-tert-butyl (3-toluyl) percarbamate; and azo compounds such as 2,2'-azobispropane, 2,2'-dichloro-2,2'-azobispropane, 1,1'-azo (methylethyl)diacetate, 2,2'-azobis(2-amidino propane) hydrochloride salt, 2,2'-azobis(2-amidinopropane) nitrate salt, 2,2'-azobisisobutane, 2,2'-azobisisobutylamide, 2,2'-azobisisobutylonitrile, methyl 2,2'-azobis-2-methylpropionate, 2,2'-dichloro-2,2'-azobisbutane, 2,2'-azobis-2-methylbutylonitrile, dimethyl 2,2'-azobisisobutyrate, 1,1'-azobis (1-methylbutylonitrile-3-sodium sulfonate), 2-(4-methylphenylazo)-2-methyl malonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovaleric acid, 2,2'-azobis-2,4-dimethylvaleronitrile, 1,1'-azobiscyclohexanenitrile, 2,2'-azobis-2-propylbutylonitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanate), and poly(tetraethyleneglycol-2,2'-azobisisobutyrate); and 1,4-bis(pentaethylene)-2-tetrazen, and 1,4-dimethoxycarbonyl-1,4-diphenyl-2-tetrazen.

The molecular weight of the binder resin in the exemplary embodiment may be adjusted by using a chain transfer agent. The chain transfer agent is not particularly limited and specifically, an agent having a covalent bond of a carbon atom and a sulfur atom may be used. More specific examples thereof include n-alkylmercaptans such as n-propylmercaptan, n-butylmercaptan, n-amylmercaptan, n-hexylmercaptan, n-heptylmercaptan, n-octylmercaptan, n-nonylmercaptan, and n-decylmercaptan; branched alkylmercaptans such as isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan, and tert-tetradecylmercaptan; and aromatic ring-containing mercaptans such as allylmercaptan, 3-phenylpropylmercaptan, phenylmercaptan, and mercaptotriphenylmethane.

A surfactant to be used is not particularly limited and a cationic surfactant, an anionic surfactant, and a nonionic surfactant may be used singly or in combination of two or more kinds.

Examples of the cationic surfactant include amine salts, and quaternary ammonium salts, and specific examples thereof include amine salts such as laurylamine hydrochloride, strearylamine hydrochloride, oleylamine acetate, stearylamine acetate, and stearylaminopropylamine acetate; and quaternary ammonium salts such as lauryltrimethylammonium chloride, dilauryldimethylammonium chloride, distearylammonium chloride, distearyldimetylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenedimethylammonium chloride, and alkyltrimethylammonium chloride.

Specific examples of the anionic surfactant include fatty acid soaps such as potassium laurate, sodium oleate, and sodium castor oil; sulfate esters such as octyl sulfate, lauryl sulfate, lauryl ether sulfate, and nonyl phenyl ether sulfate; sulfonate salts such as sodium alkylnaphthalenesulfonic acids such as lauryl sulfonate, dodecyl sulfonate, dodecylbenzene sulfonate, triisopropylnaphthalene sulfonate, and dibutylnaphthalene sulfonate, naphthalene sulfonate formalin condensates, monooctyl sulfosuccinate, dioctyl sulfosuccinate, lauric acid amide sulfonate, and oleic acid amide sulfonate; phosphoric acid esters such as lauryl phosphate, isopropyl phosphate, and nonyl phenylether phosphate; dialkyl sodium sulfosuccinates such as sodium dioctyl sulfosuccinate; and sulfosuccinate salts such as disodium lauryl sulfosuccinate and disodium polyoxyethylene lauryl sulfosuccinate.

Specific examples of the nonionic surfactants include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether, and polyoxyethylene nonyl phenyl ether; alkyl esters such as polyoxyethylene laurate, polyoxyethylene stearate, and polyoxyethylene oleate; alkyl amines such as polyoxyethylene laurylamino ether, polyoxyethylene stearylamino ether, polyoxyethylene oleylamino ether, polyoxyethylene soybeanamino ether, and polyoxyethylene beef tallowamino ether; alkyl amides such as polyoxyethylene lauric acid amide, polyoxyethylene stearic acid amide, and polyoxyethylene oleic acid amide; vegetable oil ethers such as polyoxyethylene castor oil ether, and polyoxyethylene rapeseed oil ether; alkanol amides such as lauric acid diethanolamide, stearic acid diethanolamide, and oleic acid diethanolamide; and sorbitan ester ethers such as polyoxyethylene solbitan monolaurate, polyoxyethylene sorbitan monopalmitate, polyoxyethylene sorbitan monostearate, and polyoxyethylene sorbitan monooleate.

In the exemplary embodiment, the content of the surfactant is preferably from 1000 ppm to 55000 ppm and particularly preferably from 5000 ppm to 20000 ppm with respect to the total amount of the binder resin. When the content is 1000 ppm or more, resin particles having a desired particle size are obtained and when the content is 55000 ppm or less, a rapid charge decrease due to hygroscopicity is prevented.

As a method of measuring the content of the surfactant in the binder resin of the carrier according to the exemplary embodiment, the surfactant is extracted from a binder resin extract obtained by putting 5 g of the carrier and 50 g of chloroform into a beaker, sufficiently dissolving the binder resin by an ultrasonic dispersing machine, and filtering and separating the magnetic core particles and insoluble components such as a conductive material and the content of the surfactant is obtained by a high speed liquid chromatography method.

In the carrier according to the exemplary embodiment, examples of a charge-controlling agent that may be contained in the coating layer include well-known charge-controlling agents such as a nigrosine dye, a benzimidazole compound, a quaternary ammonium salt compound, an alkoxylated amine, an alkylamide, a molybdic acid chelate pigment, a triphenylmethane compound, a salicylic acid metal salt complex, an azo-chromium complex, and copper phthalocyanine. Particularly preferable examples among these include a quaternary ammonium salt compound, an alkoxylated amine and an alkylamide.

The amount of the charge-controlling agent added to be used in the exemplary embodiment is preferably from 0.001 parts by weight to 5 parts by weight, and more preferably from 0.01 parts by weight to 0.5 parts by weight with respect to 100 parts by weight of the magnetic core particles.

When the amount of the charge-controlling agent added is 5 parts by weight or less, sufficient strength of the coating layer is obtained and easy deterioration by stress when the coating layer is used is prevented. When the amount of the charge-controlling agent added is 0.001 parts by weight or more, a function of the charge-controlling agent is sufficiently exhibited and additives such as a conductive material is evenly dispersed.

Examples of a conductive material that may be added to the coating layer in the exemplary embodiment include carbon black, metals such as gold, silver, or copper, titanium oxide, zinc oxide, tin oxide, barium sulfate, aluminum borate, potassium titanate, antimony-doped tin oxide, tin-doped indium oxide, aluminum-doped zinc oxide, and metal-coated resin particles.

The content of the conductive material is preferably from 0.01 parts by weight to 10 parts by weight, and more preferably from 0.05 parts by weight to 5 parts by weight with respect to 100 parts by weight of the binder resin in order to obtain properties which require the volume resistance of the carrier.

When the content of the conductive material is 0.01 parts by weight or more, a resistance adjusting affect may be obtained and thus the content is preferable. In addition, when the content is 10 parts by weight or less, the conductive material is not easily separated and thus the content is preferable.

In order to exhibit stable volume resistance of the carrier for a long period of time, the average thickness of the coating layer is, for example, from 0.1 μm to 10 μm, and preferably from 0.5 μm to 3 μm.

In order to achieve high image quality, the volume resistivity of the carrier according to the exemplary embodiment is preferable from $10^6$ Ω·cm to $10^{14}$ Ω·cm and more preferably from $10^8$ Ω·cm to $10^{13}$ Ω·cm at 1,000 V.

When the volume resistivity of the carrier is $10^6$ Ω·cm or more, the reproducibility of thin lines is improved and the amount of the carrier to be transferred to the photoreceptor (image holding member) is reduced and thus damage to the photoreceptor is prevented. When the volume resistivity of the carrier is $10^{14}$ Ω·cm or less, the reproducibility of a black solid image and half tone is improved.

The volume average particle size of the carrier according to the exemplary embodiment is preferably from 20 μm to 100 μm.

When the volume average particle size of the carrier is 20 μm or more, the carrier is prevented from being developed with the toner and when the volume average particle size is 100 μm or less, the toner is easily evenly charged.

Electrostatic Latent Image Developing Developer

The electrostatic charge image developer according to the exemplary embodiment is formed as a two-component developer including the carrier according to the exemplary embodiment and a toner.

Hereinafter, a toner used in the electrostatic charge image developer according to the exemplary embodiment will be described.

The toner according to the exemplary embodiment includes toner particles and as necessary, an external additive.

Toner Particles

The toner particles include, for example, a binder resin, and as necessary, a colorant, a release agent, and other external additives.

Binder Resin

Examples of the binder resin, include vinyl resins of homopolymers of monomers such as styrenes (for example, styrene, parachlorostyrene and α-methylstyrene), (meth) acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate), ethylenic unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone and vinyl isopropenyl ketone), and olefins (for example, ethylene, propylene and butadiene), and copolymers of two kinds or more of these monomers combined.

Examples of the binder resin include non-vinyl resins such as epoxy resins, polyester resins, polyurethane resins, polyamide resins, cellulose resins, polyether resins, modified rosins, mixtures of the non-vinyl resins with the above vinyl resins, and graft polymers obtained by polymerizing the above vinyl monomers under a coexistence of the above non-vinyl resins.

These binder resins may be used singly or in combination of two or more kinds.

As the binder resin, the polyester resins are preferable.

Examples of the polyester resins include known polyester resins.

An example of the polyester resin includes a condensation polymer of a polyvalent carboxylic acid and a polyol. In addition, as the polyester resin, commercially available products may be used, or synthetic resins may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkyenyl succinic acid, adipic acid and sebacic acid), alicyclic dicarboxylic acids (for example, cyclohexane dicarboxylic acid), aromatic dicarboxylic acids (for example, terephthalic acid, isophthalic acid, phthalic acid, and naphthalene dicarboxylic acid) and anhydrides and lower alkyl esters (for example, those having a carbon number of from 1 to 5) thereof. Among these polyvalent carboxylic acids, for example, aromatic dicarboxylic acids are preferably used.

As the polyvalent carboxylic acids, a trivalent or higher valent carboxylic acid which has a crosslinked structure or a branched structure may be used with dicarboxylic acids. Examples of the trivalent or higher valent carboxylic acid include trimellitic acid, pyromellitic acid, and anhydrides and lower alkyl esters (for example, those having a carbon number of from 1 to 5) thereof.

These polyvalent carboxylic acids may be used singly or in combination of two or more kinds.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol and hydrogen-added bisphenol A) and aromatic diols (for example, ethylene oxide adducts of bisphenol A and propylene oxide adducts of bisphenol A). Among these polyols, for example, aromatic diols and alicyclic diols are preferably used, and aromatic diols are more preferably used.

As the polyols, a trivalent or higher valent polyol which has a crosslinked structure or a branched structure may be used with diols. Examples of the trivalent or higher valent polyol include glycerin, trimethylolpropane, and pentaerythritol.

These polyols may be used singly or in combination of two or more kinds.

The glass transition temperature (Tg) of the polyester resin is preferably from 50° C. to 80° C. and more preferably from 50° C. to 65° C.

In addition, the glass transition temperature is determined from a DSC curve obtained from differential scanning calorimetry (DSC) and more specifically, the glass transition temperature is determined according to "extrapolated glass transition starting temperature" described in a method of calculating glass transition temperature in "Testing methods for transition temperatures of plastics" of JIS K-1987.

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The GPC molecular weight measurement is performed using GPC HLC-8120 (manufactured by Tosoh Corporation) as a measurement device and TSK-GEL SUPER HM-M (15 cm) (manufactured by Tosoh Corporation) as a column with THF as a solvent. The weight average molecular weight and the number average molecular weight are calculated using a molecular weight calibration curve prepared using a monodispersed polystyrene standard sample from the measurement result.

The polyester resin may be produced using a known preparation method. Specifically, for example, there may be a method of preparing a polyester resin at a polymerization temperature in a range from 180° C. to 230° C. by reducing the pressure in the reaction system, as necessary, and reacting raw materials while removing water and alcohol generated during condensation.

In addition, when raw material monomers are not dissolved or compatible with each other at the reaction temperature, a solvent having a high boiling point may be added thereto as a dissolution aid to dissolve the monomers. In this case, the polycondensation reaction is performed while distilling the dissolution aid. When a monomer having a poor compatibility is present, in the copolymerization reaction, the polycondensation reaction may be performed with the main component after condensing the monomer having a poor compatibility with the acid or alcohol to be polycondensed with the monomer.

The content of the binder resin is, for example, preferably from 40% by weight to 95% by weight, more preferably from 50% by weight to 90% by weight, and still more preferably from 60% by weight to 85% by weight with respect to the total amount of the toner particles.

Colorant

Examples of the colorant include various kinds of pigments such as carbon black, chrome yellow, Hansa Yellow, Benzidine Yellow, Indanthrene Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Pigment Red, Rose Bengal, Aniline Blue, Ultramarine Blue, Chalco Oil Blue, Methylene Blue Chloride, Phthalocyanine Blue, Pigment Blue, Phthalocyanine Green, and Malachite Green Oxalate, and various kinds of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes and thiazole dyes.

The colorants may be used singly or in combination of two or more kinds.

Regarding the colorant, as necessary, a surface-treated colorant may be used and a dispersant may be used in combination. In addition, various kinds of colorants may be used in combination.

For example, the content of the colorant is preferably, for example, from 1% by weight to 30% by weight and more preferably iron 3% by weight to 15% by weight with respect to the total amount of the toner particles.

Release Agent

Examples of the release agent include hydrocarbon wax; natural wax such as carnauba wax, rice wax and candelilla wax; synthetic or mineral and petroleum wax such as montan wax; and ester wax such as fatty acid ester and montanic acid ester. However, there is no limitation thereto.

The melting temperature of the release agent is preferably from 50° C. to 110° C. and more preferably from 60° C. to 100° C.

In addition, the melting temperature is determined from the DSC curve obtained from differential scanning calorimetry (DSC) according to a "melting peak temperature" described in a method of calculating melting temperature in "Testing methods for transition temperatures of plastics" of JIS K-1987.

The content of the release agent is preferably, for example, from 1% by weight to 20% by weight and more preferably from 5% by weight to 15% by weight with respect to the total amount of the toner particles.

Other Additives

Examples of the other additives include known additives such as a magnetic material, a charge-controlling agent, and an inorganic powder. These additives are contained in the toner particles as an internal additive.

Properties of Toner Particles and the Like

The toner particles may be toner particles having a single layer structure, or may be toner particles having a so-called core-shell structure constituted by a core (core particle) and a coating layer (shell layer) coating the core.

Here, the toner particles having a core-shell structure may be preferably constituted by the core containing a binder resin, and, as necessary, other additives such as a colorant and a release agent, and the coating layer containing a binder resin.

The volume average particle size (D50v) of the toner particles is preferably from 2 μm to 10 μm, and more preferably from 4 μm to 8 μm.

Various kinds of average particle sizes and particle size distribution indexes of the toner particles are measured using a COULTER MULTISIZER II (manufactured by Beckman Coulter, Inc.). ISOTON-II (manufactured by Beckman Coulter, Inc.) is used as an electrolyte.

In the measurement, 0.5 mg to 50 mg of a measurement sample is added to 2 ml of a 5% aqueous solution (sodium alkyl benzene sulfonate is preferable) solution as a dispersant. The mixture is added to 100 ml to 150 ml of the electrolyte.

The electrolyte in which the sample is suspended is subjected to a dispersion treatment for 1 minute by an ultrasonic dispersing machine, and the COULTER MULTISIZER II measures a particle size distribution of particles of from 2 μm to 60 μm by using an aperture having an aperture diameter of 100 μm. 50,000 particles are sampled.

A cumulative distribution is drawn from the smallest diameter side for the volume and the number with respect to particle size ranges (channels) divided on the basis of the particle size distributions measured in this manner. The particle sizes corresponding to 16% in the cumulative distributions are defined as a volume particle size D16v and a number particle size D16p, the particle sizes corresponding to 50% in the cumulative distributions are defined as a volume average particle size D50v and a cumulative number average particle size D50p, and the particle sizes corresponding to 84% in the cumulative distributions are defined as a volume particle size D84v and a number particle size D84p.

Using these particle sizes, a volume average particle size distribution index (GSDv) is calculated as $(D84v/D16v)^{1/2}$ and a number average particle size distribution index (GSDp) is calculated as $(D84p/D16p)^{1/2}$.

The shape factor SF1 of the toner particle is preferably from 110 to 150 and more preferably from 120 to 140.

Here, the shape factor SF1 is obtained by the following Equation.

$$SF1=(ML^2/A)\times(\pi/4)\times 100 \quad \text{Equation}$$

In the equation, ML represents an absolute maximum length of the toner particle, and A represents a projected area of the toner particle.

Specifically, the shape factor SF1 is calculated as follows mainly using a microscopic image or an image of a scanning electron microscope (SEM) that is analyzed using an image analyzer to be digitalized. That is, an optical microscopic image of particles sprayed on the surface of a glass slide is scanned into an image analyzer LUZEX through a video camera, the maximum lengths and the projected areas of 100 particles are obtained for calculation using the above-described equation, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$ and $MgSO_4$.

In the exemplary embodiment, as the above-described external additives, particularly, an external additive having an average primary particle size of 50 nm to 200 nm is preferably used from the viewpoint of obtaining stable print quality for a long period of time. However, the external additive having the particle size in the above range tends to cause particle embedding into the surface of the carrier, deformation and grinding of the surface of the carrier, and the like.

However, in the exemplary embodiment, even when the toner containing the external additive and having the particle size in the above range is used, the degree of wear of the coating layer of the carrier is appropriately controlled and as a result, image defects such as white spots may be prevented. The average primary particle size of the external additive is calculated from an image such as an SEM.

The surfaces of the inorganic particles as the external additive may be subjected to a hydrophobization treatment. For example, the hydrophobization treatment is performed, by dipping the inorganic particles in a hydrophobizing agent. The hydrophobizing agent is not particularly limited and examples thereof include a silane coupling agent, silicone oil, a titanate coupling agent and an aluminum coupling agent. These may be used singly or in combination of two or more kinds.

For example, the amount of the hydrophobizing agent is typically from 1 part by weight to 10 parts by weight with respect to 100 parts by weight of the inorganic particles.

Examples of the external additives also include resin particles (resin particles such as polystyrene, polymethyl methacrylate (PMMA) and melamine resin) and cleaning aids (for example, a metal salt of higher fatty acid represented by zinc stearate and a particle of a fluorine polymer having a high molecular weight).

The amount of the external additive externally added is, for example, preferably from 0.01% by weight to 5% by weight and more preferably from 0.01% by weight to 2.0% by weight with respect to the total amount of the toner particles.

Method of Preparing Toner

Hereinafter, a method of producing a toner according to the exemplary embodiment will be described.

The toner according to the exemplary embodiment is obtained by externally adding an external additive to toner particles after the toner particles are produced.

The toner particles may be produced, by any of a dry method (for example, kneading and pulverizing method) and a wet method (for example, an aggregation and coalescence method, a suspension polymerization method and a dissolution suspension method). The method of preparing the toner particles is not limited thereto and a known method may be employed.

Among these, the toner particles are preferably obtained using an aggregation and coalescence method.

Specifically, for example, when the toner particles are produced using the aggregation and coalescence method, the toner particles are produced through a process of preparing a resin particle dispersion in which resin particles which become a binder resin are dispersed (resin particle dispersion preparing process), a process of forming aggregated particles by aggregating the resin particles (as necessary, other particles) in the resin particle dispersion (as necessary, in the dispersion after other particles are mixed) (aggregated particle forming process), and a process of forming toner particles by heating an aggregated particle dispersion in which the aggregated particles are dispersed to coalesce the aggregated particles (coalescing process).

Hereinafter, each process will be described in detail.

While a method of obtaining toner particles containing a colorant and a release agent will be described in the following description, the colorant and the release agent are used as necessary. Any additive other than colorants and release agents may of course be used.

Resin Particle Dispersion Preparing Process

First, along with a resin particle dispersion in which resin particles which become a binder resin are dispersed, for example, a colorant particle dispersion in which colorant particles are dispersed, and a release agent dispersion in which release agent particles are dispersed are prepared.

Herein, the resin particle dispersion is prepared, for example, by dispersing the resin particles in a dispersion medium by aid of a surfactant.

An example of the dispersion solvent used in the resin particle dispersion includes an aqueous solvent.

Examples of the aqueous solvent include water such as distilled water and ion exchange water, and alcohols and the like. These may be used singly or in combination of two or more kinds.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, alkylphenol ethylene oxide adducts and polyols. Among these, particularly, anionic surfactants and cationic surfactants are preferable. The nonionic surfactants may be used in combination with anionic surfactants or cationic surfactants.

The surfactants may be used singly or in combination of two or more kinds.

In the resin particle dispersions, the resin particles may be dispersed in the dispersion medium by a general dispersion method, for example, by using a rotary shear type homogenizer, or a ball mill, a sand mill or a DYNO MILL having media. Further, depending on the kind of resin particles, the resin particles may be dispersed in the resin particle dispersion, for example, by phase inversion emulsification.

The phase inversion emulsification is a method in which a resin to be dispersed is dissolved in a hydrophobic organic solvent capable of dissolving the resin, a base is added to the organic continuous phase (O phase) to neutralize the resin, an aqueous medium (W phase) is added to invert the resin into a discontinuous phase: from W/O to O/W (so-called phase inversion), so that the resin may be dispersed in the form of particles in the aqueous medium.

The volume average particle size of the resin particles dispersed in the resin particle dispersions is preferably, for example, from 0.01 μm to 1 μm, more preferably from 0.08 μm to 0.8 μm, and still more preferably from 0.1 μm to 0.6 μm.

In addition, the volume average particle size of the resin particles is measured such that using the particle size distribution measured by a laser diffraction particle size distribution analyzer (for example, LA-700, manufactured by Horiba Seisakusho Co., Ltd.), a cumulative distribution is drawn from the small diameter side with respect to the volume based on the divided particle size ranges (channels) and the particle size at which the cumulative volume distribution reaches 50% of the total particles, particle volume is defined as a volume average particle size D50v. Hereinafter, the volume average particle size of particles in the other dispersion will be measured in the same manner.

For example, the content of the resin particles contained in the resin particle dispersion is preferably from 5% by weight to 50% by weight and more preferably from 10% by weight to 40% by weight.

For example, the colorant dispersion and the release agent particle dispersion may be prepared in a manner similar to the dispersion of resin particles. That is, with respect to the volume average particle size of the particles, the dispersion medium, the dispersion method and the content of the particles in the dispersion of the resin particles, the same is applied to the colorant particles dispersed in the colorant particles dispersion and the release agent particles dispersed in the release agent dispersion.

Aggregated Particle Forming Process

Next, along with the resin particle dispersion, the colorant particle dispersion and the release agent dispersion are mixed.

Then, in the mixed dispersion, the resin particles, the colorant particles and the release agent particles are hetero-aggregated to form aggregated particles containing the resin particles, the colorant particles and the release agent particles, which approximately have the targeted particle size of the toner particle.

Specifically, for example, an aggregation agent is added to the mixed dispersion, and the pH of the mixed dispersion is adjusted to an acidic range (for example, from pH 2 to pH 5). As necessary, a dispersion stabilizer is added thereto, followed by heating to the glass transition temperature of the resin particles (specifically, from the temperature 30° C. lower than the glass transition temperature of the resin particles to the temperature 10° C. lower than the glass transition temperature). The particles dispersed in the mixed dispersion are aggregated to form aggregated particles.

In the aggregated particle forming process, for example, the aggregation agent is added to the mixed dispersion while stirring using a rotary shear type homogenizer at room temperature (for example, 25° C.), and the pH of the mixed dispersion is adjusted to an acidic range (for example, from pH 2 to pH 5). As necessary, a dispersion-stabilizer may be added thereto, followed by heating.

Examples of the aggregation agent include a surfactant having a polarity opposite to the polarity of the surfactant used as the dispersant which is added to the mixed dispersion, for example, an inorganic metal salt and a divalent or higher-valent metal complex. In particular, when a metal complex is used as an aggregation agent, the amount of the surfactant used is reduced, which results in improvement of charging properties.

An additive capable of forming a complex or a similar bond with a metal ion in the aggregation agent may be used as necessary. As the additive, a chelating agent is suitable.

Examples of the inorganic metal salt include metal salts such as calcium chloride, calcium nitrate, barium chloride, magnesium chloride, zinc chloride, aluminum chloride and aluminum sulfate, and polymers of inorganic metal salts such as polyaluminum chloride, polyaluminum hydroxide and calcium polysulfide.

The chelating agent may be a water soluble chelating agent. Examples of the chelating agent include oxycarboxylic acids such as tartaric acid, citric acid and gluconic acid, iminodiacetic acid (IDA), nitrilotriacetic acid (NTA), and ethylenediaminetetraacetic acid (EDTA).

The amount of the chelating agent added is preferably from 0.01 part by weight to 5.0 parts by weight and more preferably 0.1 part by weight or more and less than 3.0 parts by weight with respect to 100 parts by weight of the resin particles.

Coalescing Process

Next, the aggregated particles are coalesced by heating the aggregated particle dispersion having the aggregated particles dispersed therein to, for example, the glass transition temperature of the resin particles (for example, 10° C. to 30° C. higher than the glass transition temperature of the resin particles) or higher, to form toner particles.

The toner particles are obtained by the above-described processes.

Further, the toner particles may be produced by a process of forming second aggregated particles by obtaining an aggregated particle dispersion having the aggregated particles dispersed therein, mixing the aggregated particle dispersion and the resin particle dispersion having the resin particles dispersed therein, and further performing aggregation so as to attach the resin particles on the surface of the aggregated particles, and a process of coalescing the second aggregated particles by heating a second aggregated particle dispersion having the second aggregated particles dispersed therein to form toner particles having a core and shell structure.

After the coalescing process is completed, the toner particles formed in the solution are subjected to washing, solid-liquid separation and drying processes as known in the related art to obtain dried toner particles.

The washing process may be preferably performed by replacement washing with ion exchange water from the viewpoint of charging properties. The solid-liquid separation process is not particularly limited but may be preferably performed by filtration under suction or pressure from the viewpoint of productivity. The drying process is not particularly limited but may be preferably performed by freeze-drying, flash jet drying, fluidized drying or vibration fluidized drying from the viewpoint of productivity.

The toner according to the exemplary embodiment is produced, for example, by adding and mixing the external additive to the obtained dried toner particles. The mixing may be preferably performed by a V blender, a HENSCHEL MIXER, a LÖDIGE MIXER and the like. Further, as necessary, coarse particles of the toner may be removed using a vibration sieve or a wind classifier.

In the two-component developer, a mixing ratio (weight ratio) of the toner and the carrier is preferably toner:carrier 1:100 to 30:100, and more preferably 3:100 to 20:100.

Image Forming Apparatus and Image Forming Method

Next, an image forming apparatus and an image forming method according to the exemplary embodiment will be described.

The image forming apparatus according to the exemplary embodiment includes an image holding member, a charging unit that charges the surface of the image holding member, an electrostatic charge image forming unit that forms an electrostatic charge image on a charged surface of the image holding member, a developing unit that accommodates an electrostatic charge image developer, and develops the electrostatic charge image formed on the surface of the image holding member as a toner image with the electrostatic charge image developer, a transfer unit that transfers the toner image formed on the surface of the image holding member onto the surface of a recording medium, and a fixing unit that fixes the toner image transferred onto the surface of the recording medium. As the electrostatic charge image developer, the electrostatic charge image developer according to the exemplary embodiment is used.

In the image forming apparatus according to the exemplary embodiment, there is carried out an image forming method (an image forming method according to the exemplary embodiment) including charging a surface of an image holding member, forming an electrostatic charge image on a charged surface of the image holding member, developing the electrostatic charge image formed on the surface of the image holding member as a toner image using the electrostatic charge image developer according to the exemplary embodiment, transferring the toner image formed on the surface of the image holding member onto the surface of a recording medium, and fixing the toner image transferred onto the surface of the recording medium.

As the image forming apparatus according to the exemplary embodiment, known image forming apparatuses such as a direct transfer type image forming apparatus which directly transfers a toner image formed on the surface of an image holding member onto a recording medium; an intermediate transfer type image forming apparatus which primarily transfers a toner image formed on the surface of an image holding member onto the surface of an intermediate transfer member and secondarily transfers the toner image transferred on the surface of the intermediate transfer member onto the surface of a recording medium; an image forming apparatus including a cleaning unit which cleans the surface of an image holding member before charge and after a toner image is transferred; and an image forming apparatus including an erasing unit which erases a charge from the surface of an image holding member before charge and after a toner image is transferred by irradiating the surface with erasing light may be used.

In the case of the intermediate transfer type image forming apparatus, for example, a transfer unit includes an intermediate transfer member in which a toner image is transferred onto the surface, a primary transfer unit which primarily transfers the toner image formed on the surface of the image holding member onto the surface of the intermediate transfer member, and a secondary transfer unit which secondarily transfers the toner image transferred onto the surface of the intermediate transfer member onto the surface of a recording medium.

In the image forming apparatus according to the exemplary embodiment, for example, a portion including the developing unit may have a cartridge structure (process cartridge) which is detachable from the image forming apparatus. As the process cartridge, for example, a process cartridge which accommodates the electrostatic charge image developer according to the exemplary embodiment and is provided with the developing unit is suitably used.

Hereinafter, an example of the image forming apparatus according to the exemplary embodiment will be shown, however, there is no limitation thereto. In addition, main parts shown in the drawing will be described, and the descriptions of the other parts will be omitted.

FIG. 1 is a configuration diagram schematically showing an image forming apparatus according to an exemplary embodiment.

The image forming apparatus shown in FIG. 1 includes first to fourth electrophotographic image forming units (image forming units) 10Y, 10M, 10C, and 10K which output images of the respective colors including yellow (Y), magenta (M), cyan (C), and black (K) on the basis of color-separated image data. These image forming units (hereinafter, also referred to simply as "units" in some cases) 10Y, 10M, 10C and 10K are aligned in the horizontal direction with predetermined distances therebetween. Incidentally, each of these units 10Y, 10M, 10C and 10K may be a process cartridge which is detachable from the image forming apparatus.

An intermediate transfer belt 20 is provided through each unit as an intermediate transfer member extending above each of the units 10Y, 10M, 10C and 10K in the drawing. The intermediate transfer belt 20 is provided around a drive roller 22 and a support roller 24 which contacts the inner surface of the intermediate transfer belt 20, which are separated from each other from left to right in the drawing. The intermediate transfer belt 20 travels in a direction from the first unit 10Y to the fourth unit 10K. Incidentally, the support roller 24 is pushed in a direction of separation from the drive roller 22 by a spring or the like (not shown), such that tension is applied to the intermediate transfer belt 20 which is provided around the support roller 24 and the drive roller 22. Also, on the surface of the image holding member side of the intermediate transfer belt 20, an intermediate transfer member cleaning device 30 is provided opposing the drive roller 22.

In addition, toners in the four colors of yellow, magenta, cyan and black, which are accommodated in toner cartridges 8Y, 8M, 8C and 8K, respectively, are supplied to developing devices (developing units) 4Y, 4M, 4C and 4K of the above-described units 10Y, 10M, 10C and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. In addition, the same components as those of the first unit 10Y are represented by reference numerals to which the symbols M (magenta), C (cyan), and K (black) are attached instead of the symbol Y (yellow), and the descriptions of the second to fourth units 10M, 10C, and 10K, will be omitted.

The first unit 10Y includes a photoreceptor 1Y functioning as the image holding member. Around the photoreceptor 1Y, there are successively disposed a charging roller 2Y (an example of the charging unit) for charging the surface of the photoreceptor 1Y to a predetermined potential, an exposure device 3 (an example of the electrostatic charge image forming unit) for exposing the charged surface with a laser beam 3Y on the basis of a color-separated image signal to form an electrostatic charge image, the developing device 4Y (an example of the developing unit) for supplying a charged toner into the electrostatic charge image to develop the electrostatic charge image, a primary transfer roller 5Y (an example of the primary transfer unit) for transferring the developed toner image onto the intermediate transfer belt 20, and a photoreceptor cleaning device 6Y (an example of the cleaning unit) for removing the toner remaining on the surface of the photoreceptor 1Y after the primary transfer.

The primary transfer roller 5Y is disposed inside the intermediate transfer belt 20 and provided opposite to the photoreceptor 1Y. Further, bias power supplies (not shown), which apply primary transfer biases, are respectively connected to the respective primary transfer rollers 5Y, 5M, 5C and 5K. A controller (not shown) controls the respective bias power supplies to change the transfer biases which are applied to the respective primary transfer rollers.

Hereinafter, the operation of forming a yellow image in the first unit 10Y will be described.

First, before the operation, the surface of the photoreceptor 1Y is charged to a potential of −600 V to −800 V by the charging roller 2Y.

The photoreceptor 1Y is formed by stacking a photosensitive layer on a conductive substrate (volume resistivity at 20° C.: $1\times10^{-6}$ Ωcm or lower). In general, this photosensitive layer has high resistance (resistance similar to that of general resin), and has properties in which, when irradiated with the laser beam 3Y, the specific resistance of a portion irradiated with the laser beam changes. Therefore, the laser beam 3Y is output to the charged surface of the photoreceptor 1Y through the exposure device 3 in accordance with yellow image data sent from the controller (not shown). The photosensitive layer on the surface of the photoreceptor 1Y is irradiated with the laser beam 3Y. As a result, an electrostatic charge image having a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charged charge flows on the surface of the photoreceptor 1Y and, in contrast, when the charge remains in a portion which is not irradiated with the laser beam 3Y.

The electrostatic charge image which is formed on the photoreceptor 1Y in this manner is rotated to a predetermined development position along with the travel of the photoreceptor 1Y. At this development position, the electrostatic charge image on the photoreceptor 1Y is visualized (developed) as a toner image by the developing device 4Y.

The developing device 4Y accommodates, for example, the electrostatic charge image developer, which contains at least a yellow toner and a carrier. The yellow toner is frictionally charged by being stirred in the developing device 4Y to have a charge with the same polarity (negative polarity) as that of a charge charged on the photoreceptor 1Y and is maintained on a developer roller (as an example of the developer holding member). When the surface of the photoreceptor 1Y passes through the developing device 4Y, the yellow toner is electrostatically attached to a latent image portion at which the charge is erased from the surface of the photoreceptor 1Y, and the latent image is developed with the yellow toner. The photoreceptor 1Y on which a yellow toner image is formed subsequently travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has a (+) polarity opposite to the polarity (−) of the toner. For example, the first unit 10Y is controlled to +10 μA by the controller (not shown).

On the other hand, the toner remaining on the photoreceptor 1Y is removed and collected by the photoreceptor cleaning device 6Y.

Also, primary transfer biases to be applied respectively to the primary transfer rollers 5M, 5C and 5K at the second unit 10M and subsequent units, are controlled similarly to the primary transfer bias of the first unit.

In this manner, the intermediate transfer belt 20 having a yellow toner image transferred thereonto from the first unit 10Y is sequentially transported through the second to fourth units 10M, 10C and 10K, and toner images of respective colors are superimposed and multi-transferred.

The intermediate transfer belt 20 having the four toner images multi-transferred thereonto through the first to fourth units arrives at a secondary transfer portion which is configured to have the intermediate transfer belt 20, the support roller 24 contacting with the inner surface of the intermediate transfer belt and a secondary transfer roller 26 (an example of the secondary transfer unit) disposed on the side of the image holding surface of the intermediate transfer belt 20. Meanwhile, a recording sheet P (an example of the recording medium) is supplied to a gap at which the secondary transfer roller 26 and the intermediate transfer belt 20 are contacted with each other at a predetermined timing through a supply mechanism and a secondary transfer bias is applied to the support roller 24. The transfer bias applied at this time has the same polarity as the polarity of the toner, and an electrostatic force directing from the intermediate transfer belt 20 toward the recording sheet P acts upon the toner image, whereby the toner image on the intermediate transfer belt 20 is transferred onto the recording sheet P. Incidentally, at this time, the secondary transfer bias is determined depending upon a resistance detected by a resistance detecting unit (not shown) for detecting a resistance of the secondary transfer portion, and the voltage is controlled.

Then, the recording sheet P is sent to a press contact portion (nip portion) of a pair of fixing rollers in a fixing device 28 (an example of the fixing unit), and the toner image is fixed onto the recording sheet P to form a fixed image.

Examples of the recording sheet P onto which the toner image is transferred include plain paper used for electrophotographic copying machines, printers and the like. As the recording medium, other than the recording sheet P, OHP sheets may be used.

In order to improve the smoothness of the image surface after the fixing, the surface of the recording sheet P is preferably smooth, for example, coated paper in which the surface of plain paper is coated with a resin and the like, art paper for printing and the like are suitably used.

The recording sheet P in which fixing of a color image is completed is transported to an ejection portion, and thus a series of the color image formation operations end.

Process Cartridge and Developer Cartridge

A process cartridge according to the exemplary embodiment will be described.

The process cartridge according to the exemplary embodiment includes a developing unit, which accommodates the electrostatic charge image developer according to the exemplary embodiment and develops an electrostatic charge image formed on an image holding member as a toner image with the electrostatic charge image developer, and is detachable from the image forming apparatus.

The configuration of the process cartridge according to the exemplary embodiment is not limited thereto and may include a developing device and, additionally, at least one selected from other units such as an image holding member, a charging unit, an electrostatic charge image forming unit, and a transfer unit, as necessary.

Hereinafter, an example of the process cartridge according to the exemplary embodiment will be shown and the process cartridge is not limited, thereto. Main parts shown in the drawing will be described and the descriptions of other parts will be omitted.

Figure 2:
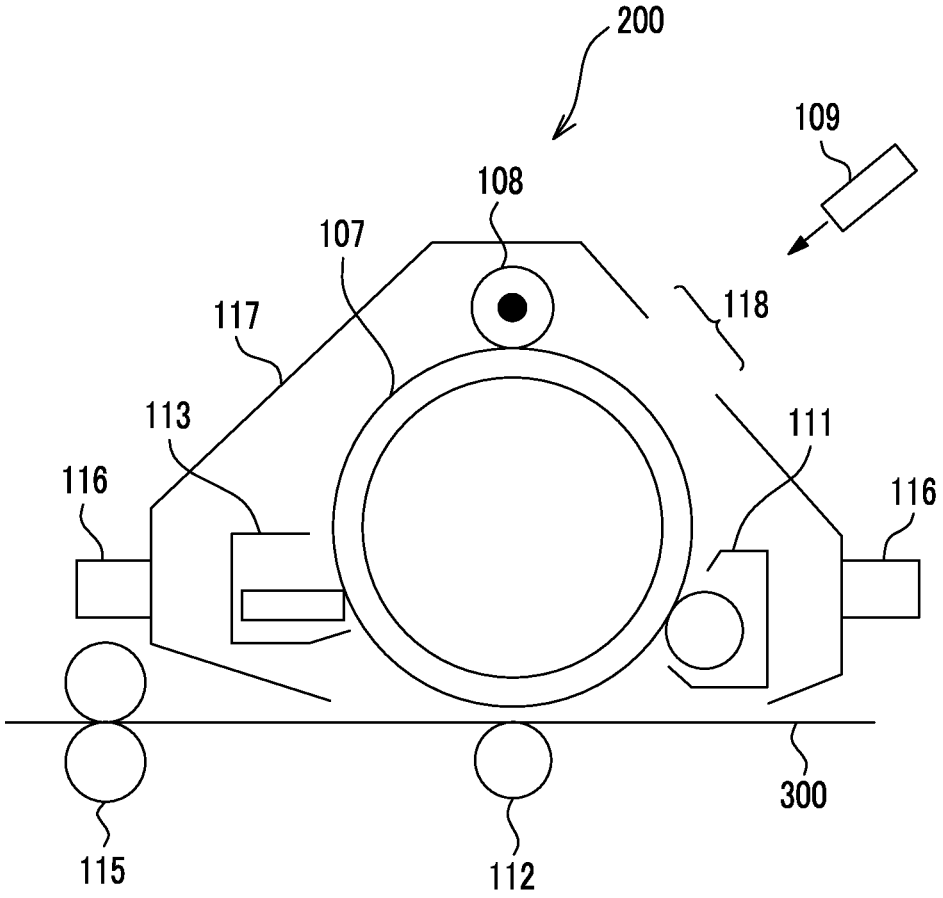
FIG. 2 is a configuration diagram schematically showing an example of a process cartridge according to an exemplary embodiment.

FIG. 2 is a configuration diagram schematically showing a process cartridge according to an exemplary embodiment.

A process cartridge 200 shown in FIG. 2 includes, a photoreceptor 107 (an example of the image holding member), a charging roller 108 (an example of the charging unit), a developing device 111 (an example of the developing unit) and a photoreceptor cleaning device 113 (an example of the cleaning unit) provided in the periphery of the photoreceptor 107, all of which are integrally combined and supported, for example, by a housing 117 provided with a mounting rail 116 and an opening portion 118 for exposure to form a cartridge.

In FIG. 2, 109 denotes an exposure device (an example of the electrostatic charge image forming unit), 112 denotes a transfer device (an example of the transfer unit), 115 denotes a fixing device (an example of the fixing unit), and 300 denotes recording sheet (an example of the recording medium).

Next, a developer cartridge according to the exemplary embodiment will be described.

The developer cartridge according to the exemplary embodiment is a developer cartridge including a container which accommodates the electrostatic charge image developer according to the exemplary embodiment, wherein the developer cartridge is detachable from the image forming apparatus. The developer cartridge accommodates the electrostatic charge image developer for replenishment in order to supply the toner to the developing unit provided in the image forming apparatus.

EXAMPLES

The exemplary embodiments are more specifically described below with reference to the following Examples, but the exemplary embodiments are not limited to these Examples.

Preparation of Binder Resin Particles 1 for Forming Coating Layer

Cyclohexyl methacrylate monomer: 100 parts by weight

Dodecanethiol: 1 part by weight

The above components are mixed and dissolved and the mixture is subjected to emulsion polymerization in a flask in which 0.5 parts by weight of a cationic surfactant (stearyltrimethylammoniumchloride compound, QUARTAMINE 86P CONC: manufactured by Kao Corporation) is dissolved in 400 parts by weight of ion exchange water. 50 parts by weight of ion exchange water in which 0.5 parts by weight of an initiator (V-50: manufactured by Wako Pure Chemical Industries, Ltd.) is dissolved is added to the mixture while the mixture is mixed gently for 10 minutes. After the flask is purged with nitrogen, the mixture is heated to 70° C. in an oil bath while the mixture in the flask is stirred and the emulsion polymerization continues for 5 hours as it is. As a result, a binder resin dispersion 1 in which binder resin particles having a volume average particle size of 350 nm are dispersed is obtained. The binder resin dispersion 1 is freeze-dried to obtain binder resin particles 1.

When the weight average molecular weight of the binder resin particles is measured using HLC-8120 GPC and SC-8020 apparatus (manufactured by Tosoh Corporation) with tetrahydrofuran (THF) as an eluent in terms of standard styrene molecular weight, the weight average molecular weight is 345,000.

Preparation of Binder Resin Particles 2 for Forming Coating Layer

Cyclohexyl methacrylate monomer: 100 parts by weight

Dodecanethiol: 1 part by weight

The above components are mixed and dissolved and the mixture is subjected to emulsion polymerization in a flask in which 0.5 parts by weight of an anionic surfactant (NEOGEN SC, manufactured by Dai-ichi Kogyo Seiyaku Co., Ltd.) is dissolved in 400 parts by weight of ion exchange water. 50 parts by weight of ion exchange water in which 0.5 parts by weight of an initiator (ammonium persulfate) is dissolved is added to the mixture while the mixture is mixed gently for 10 minutes. After the flask is purged with nitrogen, the mixture is heated to 70° C. in an oil bath while the mixture in the flask is stirred and the emulsion polymerization continues for 5 hours as it is. As a result, a binder resin particle dispersion 2 in which binder resin particles having a volume average particle size of 300 nm are dispersed is obtained. The binder resin particle dispersion 2 is freeze-dried to obtain binder resin particles 2.

The weight average molecular weight of the binder resin particles is 350,000.

Preparation of Binder Resin Particles 3 for Forming Coating Layer

Methyl methacrylate monomer: 80 parts by weight

Styrene monomer: 20 parts by weight

A binder resin particles dispersion 3 in which resin particles having a volume average particle size of 320 nm are dispersed is obtained in the same manner as in the preparation method of the binder resin particles 2 for forming a coating layer except that the composition of the monomers is changed as above. The binder resin particles dispersion 3 is freeze-dried to obtain binder resin particles 3.

The weight average molecular weight of the binder resin particles is 320,000.

Preparation of Crosslinked Resin Particles 1

Cyclohexyl methacrylate monomer: 95 parts by weight

Polyethylene glycol dimethacrylate monomer: 5 parts by weight

Dodecanethiol: 1 part by weight

The above components are mixed and dissolved and the mixture is subjected to emulsion polymerization in a flask in which 0.5 parts by weight of an anionic surfactant (NEOGEN SC, manufactured by Dai-ichi Kogyo Seiyaku Co., Ltd.) is dissolved in 400 parts by weight of ion exchange water. 50 parts by weight of ion exchange water in which 0.5 parts by weight of an initiator (ammonium persulfate) is dissolved is added to the mixture while the mixture is mixed gently for 10 minutes. After the flask is purged with nitrogen, the mixture is heated to 70° C. in an oil bath while the mixture in the flask is stirred and the emulsion polymerization continues for 5 hours as it is. As a result, a crosslinked resin particle dispersion 1 in which resin particles having a volume average particle size of 300 nm are dispersed is obtained. The crosslinked resin particle dispersion 1 is freeze-dried to obtain crosslinked resin particles 1.

Preparation of Crosslinked Resin Particles 2

Methyl methacrylate monomer: 95 parts by weight

Polyethylene glycol dimethacrylate monomer: 5 parts by weight

Dodecanethiol: 1 part by weight

The above components are mixed and dissolved and the mixture is subjected to emulsion polymerization in a flask in which 0.5 parts by weight of an anionic surfactant (NEOGEN SC, manufactured by Dai-ichi Kogyo Seiyaku Co., Ltd.) is dissolved in 400 parts by weight of ion exchange water. 50 parts by weight of ion exchange water in which 0.5 parts by weight of an initiator (ammonium persulfate) is dissolved is added to the mixture while the mixture is mixed gently for 10 minutes. After the flask is purged with nitrogen, the mixture is heated to 70° C. in an oil bath while the mixture in the flask is stirred and the emulsion polymerization continues for 5 hours as it is. As a result, a crosslinked resin particle dispersion 2 in which resin particles having a volume average particle size of 280 nm are dispersed is obtained. The crosslinked resin particle dispersion 2 is freeze-dried to obtain crosslinked resin particles 2.

Example 1

Preparation of Carrier

Ferrite particles (Mn—Mg ferrite, true specific gravity: 4.7 g/cm$^3$, volume average particle size: 40 μm, saturation magnetization: 60 emu/g, surface roughness: 1.5 μm): 100 parts by weight Binder resin particles 1 for forming coating layer: 1.5 parts by weight Thermosetting resin particles: 0.5 parts by weight (EPOSTAR S: manufactured by Nippon Shokubai Co., Ltd., melamine-formaldehyde condensed resin particles, 200 nm)

Crosslinked resin particle 1: 0.5 parts by weight

Carbon Black: 0.5 parts by weight

The above-described materials are put in a 5 L HENSCHEL MIXER (manufactured by NIPPON COKE & ENGINEERING. CO., LTD.) and mixed at 2,000 rpm for 60 minutes, and the resin particles are immobilized on ferrite particles. The temperature of the HENSCHEL MIXER is maintained at 100° C. and the mixture is stirred at 2,000 rpm for 20 minutes. Then, the temperature is cooled to 50° C. while rotating is performed at 1,000 rpm, and thus a carrier 1 for forming a coating layer is obtained. The carrier for forming a coating layer is sieved with a sieve having a mesh of 75 μm to obtain a carrier 1.

Preparation of Externally Added Toner 1

A mixture of 100 parts of a styrene-butyl acrylate copolymer (weight average molecular weight Mw=150,000, copolymerization ratio 80:20), 5 parts of carbon black (MOGUL L, manufactured by Cabot Corporation), and 6 parts of carnauba wax is kneaded using an extruder, pulverized using a jet mill, then, a spheroidizing treatment using warm air is carried out using a KRYPTRON (manufactured by Kawasaki Heavy Industries Ltd.), and the mixture is classified using a wind-power classifier, thereby obtaining toner particles having a particle diameter of 6.2 μm.

100 parts by weight of toner particles, 1.2 parts by weight of a silicone oil-treated silica particles having an average primary particle of 40 nm (RY50: manufactured by Nippon Aerosil Co., Ltd.), and 1.5 parts by weight of hexamethyldisilazane (HMDS)-treated silica particles having an average primary particle size of 150 nm are mixed using a sample mill to obtain an externally added toner 1.

8 parts by weight of the externally added toner 1 and 100 parts by weight of the carrier 1 are stirred using a V blender at 40 rpm for 20 minutes and the resultant is sieved using a sieve having a mesh of 125 μm to obtain a developer 1.

Evaluation of Carrier and Developer

Using the above-described developer 1, 1% printing charts are printed on 100,000 sheets of paper under a high temperature and high humidity environment of 35° C. and 85% RH with modified machine of DOCU CENTRE COLOR 500 copying machine (manufactured by Fuji Xerox Co., Ltd.). After the printing charts are printed in the initial stage (10th sheet), 10,000 sheets, 50,000 sheets, 80,000 sheets, and 100,000 sheets are printed respectively and then 100,000 sheets are printed and then kept for 72 hours. Thereafter, the quality of a halftone image, white spots, and reproducibility of thin lines which are easily affected by charging properties are evaluated by the following criteria. The obtained results are shown in Table 2.

Halftone Image Quality

A: A case in which deterioration in halftone image quality is not recognized at all by visual observation.

B: A case in which deterioration in halftone image quality is slightly recognized by visual observation.

C: A case in which deterioration in halftone image quality is remarkably recognized by visual observation.

White Spots

A halftone image is continuously printed on 10 sheets of A3 paper and the number of white spots is counted.

A: The number of white spots is 3 or less.

B: The number of white spots is from 4 to 10.

C: The number of white spots is 11 or more.

Reproducibility of Thin Lines

Line images are output as 5 cm×5 cm charts in the vertical direction against the developing direction on the upper left, center and lower right of A4 paper by using the above modified machine at a resolution of 2,400 dpi (dot per inch). The grades of the output samples are evaluated using a graduated loupe of ×100 magnifications based on a distance at which the gap between lines is the narrowest due to scattering of the toner, or the like according to the following criteria. The obtained results are shown in Table 2.

A: A case in which a reduction in the distance by scattering or an increase in the distance by narrowing the gap between thin lines is rarely observed.

B: A case in which a reduction or increase in the distance is observed but thin lines may be confirmed.

C: A case in which the distance between thin lines is not able to be determined or missing is observed.

Example 2

A carrier 2 and a developer 2 shown in Table 1 are prepared in the same manner as in Example 1 except that the binder resin particles 1 for forming a coating layer in Example 1 are changed to the binder resin particles 2 for forming a coating layer and evaluation is performed. The obtained results are shown in Table 2.

Example 3

A carrier 3 and a developer 3 shown in Table 1 are prepared in the same manner as in Example 1 except that the binder resin particles 1 for forming a coating layer in Example 1 are changed to the binder resin particles 3 for forming a coating layer and the crosslinked resin particles 1 are changed to the crosslinked resin particles 2 and evaluation is performed. The obtained results are shown in Table 2.

Example 4

A carrier 4 and a developer 4 shown in Table 1 are prepared in the same manner as in Example 1 except that 0.5 parts by weight of the thermosetting resin particles (EPOSTAR S: manufactured by Nippon Shokubai Co., Ltd.) in Example 1 is changed to 1.0 parts by weight the thermosetting resin particles (EPOSTAR MS: manufactured by Nippon Shokubai Co., Ltd., benzoguanamine-formaldehyde condensed resin particles, 1 μm) and evaluation is performed. The obtained results are shown in Table 2.

Comparative Example 1

A carrier 5 and a developer 5 shown in Table 1 are prepared in the same manner as in Example 1 except that the binder resin particles 1 for forming a coating layer in Example 1 are changed to the binder resin particles 3 for forming a coating layer and evaluation is performed. The obtained results are shown in Table 2.

Comparative Example 2

A carrier 6 and a developer 6 shown in Table 1 are prepared in the same manner as in Example 1 except that the thermosetting resin particles in Example 1 is changed to 1 part of the crosslinked resin particles 1 and evaluation is performed. The obtained results are shown in Table 2.

Comparative Example 3

A carrier 7 and a developer 7 shown in Table 1 are prepared in the same manner as in Example 1 except that the amount of thermosetting resin particles 1 in Example 1 is set to 1 part and the crosslinked resin particles 1 is excluded and evaluation is performed. The obtained results are shown in Table 2.

As seen from the result of Examples 1 to 4, when the developer carrier including the magnetic core particle having the coating layer and the binder resin is a polymer including the thermosetting resin particles and the cross-

TABLE 1

| | Carrier | | | | |
|---|---|---|---|---|---|
| | No | Binder resin | Thermosetting resin particles | Crosslinked resin particles | Externally added toner |
| Developer 1 | 1 | (1) Cyclohexyl methacrylate | Melamine resin | (1) Cyclohexyl methacrylate/ polyethylene glycol dimethacrylate | 1 |
| Developer 2 | 2 | (2) Cyclohexyl methacrylate | Melamine resin | (1) Cyclohexyl methacrylate/ polyethylene glycol dimethacrylate | 1 |
| Developer 3 | 3 | (3) Methyl methacrylate/styrene | Melamine resin | (2) Methyl methacrylate/ polyethylene glycol dimethacrylate | 1 |
| Developer 4 | 4 | (1) Cyclohexyl methacrylate | Benzoguanamine resin | (1) Cyclohexyl methacrylate/ polyethylene glycol dimethacrylate | 1 |
| Developer 5 | 5 | (3) Methacrylate/ styrene | Melamine resin | (1) Cyclohexyl methacrylate/ polyethylene glycol dimethacrylate | 1 |
| Developer 6 | 6 | (1) Cyclohexyl methacrylate | — | (1) Cyclohexyl methacrylate/ polyethylene glycol dimethacrylate | 1 |
| Developer 7 | 7 | (1) Cyclohexyl methacrylate | Melamine resin | — | 1 |

TABLE 2

| | | Image Evaluation | | | | | | | | |
|---|---|---|---|---|---|---|---|---|---|---|
| | | Halftone image quality | | | | | | White spots | | |
| | Developer | Initial stage | 10,000 | 50,000 | 80,000 | 100,000 | Being left | Initial stage | 10,000 | 50,000 |
| Example 1 | 1 | A | A | A | A | A | A | A | A | A |
| Example 2 | 2 | A | A | A | A | A | A | A | A | A |
| Example 3 | 3 | A | A | A | A | A | A | A | A | A |
| Example 4 | 4 | A | A | A | A | A | A | A | A | A |
| Comparative Example 1 | 5 | A | A | A | A | A | C | A | A | A |
| Comparative Example 2 | 6 | A | A | A | A | B | C | A | A | A |
| Comparative Example 3 | 7 | A | A | A | A | A | C | A | A | A |

| | Image Evaluation | | | | | | | | |
|---|---|---|---|---|---|---|---|---|---|
| | White spots | | | Reproducibility of thin lines | | | | | |
| | 80,000 | 100,000 | Being left | Initial stage | 10,000 | 50,000 | 80,000 | 100,000 | Being left |
| Example 1 | A | A | A | A | A | A | A | A | A |
| Example 2 | A | A | A | A | A | A | A | A | A |
| Example 3 | A | A | A | A | A | A | A | A | A |
| Example 4 | A | A | A | A | A | A | A | A | A |
| Comparative Example 1 | A | A | C | A | A | A | A | A | C |
| Comparative Example 2 | A | A | C | A | A | A | A | B | C |
| Comparative Example 3 | A | A | B | A | A | A | A | A | B |

linked resin particles in the binder resin and obtained by polymerizing the same monomer, included in the crosslinked resin particle, as the monomer in the binder resin, compared to the developers in Comparative Examples 1 to 3, a decrease in charge after an image is formed in a high temperature and high humidity environment for a long period of time is prevented and thus image defects are prevented. In addition, when the developers in Examples 1 to 4 are used, compared to the developers in Comparative Examples 1 to 3, deterioration in halftone image quality after an image is formed in a high temperature and high humidity environment for a long period of time and after being kept is prevented, white spots are prevented, and the reproducibility of thin lines is satisfactory.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing carrier comprising:

a magnetic core particle; and a coating layer that coats surfaces of the magnetic core particle, wherein the coating layer includes a binder resin, thermosetting resin particles, and crosslinked resin particles, the crosslinked resin particle contains a polymer formed by polymerizing a monomer component including the same monomer as a monomer used in the polymerization of the binder resin, a weight ratio between the thermosetting resin particles and the crosslinked resin particles (thermosetting resin particles:crosslinked resin particles) is from 1:4 to 4:1, the crosslinked resin particles contain a polymer formed by polymerizing a cyclohexyl (meth)acrylate monomer, the binder resin contains a polymer formed by polymerizing a cyclohexyl (meth)acrylate monomer, and the thermosetting resin particles comprise a resin selected from the group consisting of a melamine resin, a urea resin, a urethane resin, a guanamine resin and an amine resin.

2. The electrostatic charge image developing carrier according to claim 1, wherein the crosslinked resin particles have a volume average particle size of 10 nm to 1000 nm.

3. The electrostatic charge image developing carrier according to claim 1, wherein a ratio of the same monomer of the crosslinked resin particles with respect to a total monomer component is 50 mol % or more.

4. The electrostatic charge image developing carrier according to claim 1, wherein as an amount of resin particles added, a total amount of the thermosetting resin particles and the crosslinkable resin particles added with respect to 100 parts by weight of the magnetic core particles is from 0.01 parts by weight to 5 parts by weight.

5. An electrostatic charge image developer comprising:

an electrostatic charge image developing toner; and the electrostatic charge image developing carrier according to claim 1.

6. The electrostatic charge image developer according to claim 5, wherein the electrostatic charge image developing toner includes an external additive having an average primary particle size of 50 nm to 200 nm.

7. A developer cartridge comprising:

a container that accommodates the electrostatic charge image developer according to claim 5, wherein the developer cartridge is detachable from an image forming apparatus.

8. A process cartridge comprising:

a developing unit that accommodates the electrostatic charge image developer according to claim 5 and develops an electrostatic charge image formed on a surface of an image holding member as a toner image with the electrostatic charge image developer, wherein the process cartridge is detachable from an image forming apparatus.

* * * * *